US012082620B2

(12) United States Patent
Cho et al.

(10) Patent No.: US 12,082,620 B2
(45) Date of Patent: Sep. 10, 2024

(54) AEROSOL GENERATING DEVICE AND OPERATION METHOD THEREOF

(71) Applicant: KT&G CORPORATION, Daejeon (KR)

(72) Inventors: Byung Sung Cho, Gwangmyeong-si (KR); Won Kyeong Lee, Guri-si (KR); Jong Sub Lee, Seongnam-si (KR); Dae Nam Han, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 1039 days.

(21) Appl. No.: 16/970,434

(22) PCT Filed: Apr. 14, 2020

(86) PCT No.: PCT/KR2020/005019
§ 371 (c)(1),
(2) Date: Aug. 17, 2020

(87) PCT Pub. No.: WO2020/213917
PCT Pub. Date: Oct. 22, 2020

(65) Prior Publication Data

US 2023/0141960 A1 May 11, 2023

(30) Foreign Application Priority Data

Apr. 18, 2019 (KR) ..... 10-2019-0045645

(51) Int. Cl.
*A24F 40/57* (2020.01)
*A24F 40/42* (2020.01)
(Continued)

(52) U.S. Cl.
CPC ..... *A24F 40/57* (2020.01); *A24F 40/42* (2020.01); *A24F 40/51* (2020.01); *A24F 40/53* (2020.01); *A24F 40/60* (2020.01)

(58) Field of Classification Search
CPC ..... A24F 40/60; A24F 40/57; A24F 40/53; A24F 40/65; H05B 1/0291
See application file for complete search history.

(56) References Cited

U.S. PATENT DOCUMENTS 3,810,476 A 5/1974 Thomas
7,180,037 B2 * 2/2007 Weiss ..... G05D 23/24 219/505
(Continued)

FOREIGN PATENT DOCUMENTS

CN 107407941 A 11/2017
CN 109043675 A 12/2018
(Continued)

OTHER PUBLICATIONS

GB-2544372-A with translation (Year: 2017).*
(Continued)

*Primary Examiner* — Marcus E Harcum
(74) *Attorney, Agent, or Firm* — Sughrue Mion, PLLC

(57) ABSTRACT

Provided is an aerosol generating device including a heater that heats an aerosol-generating material and a controller that controls power supplied to the heater. The controller may measure a resistance value of the heater by using at least one electrical characteristic associated with the heater, select any one power profile from among a plurality of pre-stored power profiles including values of power to be supplied to the heater, such that a temperature of the heater reaches a target temperature within a predetermined time from a time point at which power supply to the heater is initiated regardless of variation in the resistance value of the heater, and control power supplied to the heater according to the selected power profile.

11 Claims, 5 Drawing Sheets

(51) Int. Cl.

| | |
|---|---|
| ***A24F 40/51*** | (2020.01) |
| ***A24F 40/53*** | (2020.01) |
| ***A24F 40/60*** | (2020.01) |

(56) References Cited

U.S. PATENT DOCUMENTS

| | | | | |
|---|---|---|---|---|
| 9,423,152 | B2 | 8/2016 | Ampolini et al. | |
| 9,949,507 | B2 | 4/2018 | Flick | |
| 10,470,496 | B2 | 11/2019 | Bernauer et al. | |
| 10,667,329 | B2 * | 5/2020 | Bernauer | H05B 1/0291 |
| 11,039,504 | B2 * | 6/2021 | Kondo | G01R 31/382 |
| 11,413,410 | B2 | 8/2022 | Buchberger et al. | |
| 11,484,673 | B2 * | 11/2022 | Soriano | A61M 15/06 |
| 11,558,933 | B2 * | 1/2023 | Lemke | H05B 1/0291 |
| 11,596,182 | B2 | 3/2023 | Lee et al. | |
| 11,641,883 | B2 * | 5/2023 | Qiu | A24F 40/40 131/329 |
| 2013/0104916 | A1 * | 5/2013 | Bellinger | A61M 11/042 131/328 |
| 2013/0319440 | A1 * | 12/2013 | Capuano | A24F 40/50 131/329 |
| 2014/0270727 | A1 | 9/2014 | Ampolini et al. | |
| 2016/0174611 | A1 | 6/2016 | Monsees et al. | |
| 2016/0309784 | A1 | 10/2016 | Silvestrini et al. | |
| 2017/0064997 | A1 * | 3/2017 | Murison | H02J 7/0044 |
| 2017/0360094 | A1 | 12/2017 | Kuczaj | |
| 2018/0020735 | A1 * | 1/2018 | Bilat | H05B 3/44 131/328 |
| 2018/0070641 | A1 | 3/2018 | Batista et al. | |
| 2018/0077967 | A1 | 3/2018 | Hatton et al. | |
| 2018/0084608 | A1 | 3/2018 | Bernauer et al. | |
| 2018/0110943 | A1 * | 4/2018 | Raichman | A24D 1/20 |
| 2018/0132526 | A1 * | 5/2018 | Davis | A24F 40/60 |
| 2018/0220711 | A1 * | 8/2018 | Suzuki | A24F 40/65 |
| 2018/0303161 | A1 | 10/2018 | Bilat | |
| 2020/0113246 | A1 * | 4/2020 | Barbaric | A24F 40/53 |
| 2020/0128878 | A1 | 4/2020 | Stura et al. | |
| 2020/0305512 | A1 | 10/2020 | Lim et al. | |

FOREIGN PATENT DOCUMENTS

| | | | |
|---|---|---|---|
| JP | 2000-041654 | A | 2/2000 |
| KR | 10-2015-0130458 | A | 11/2015 |
| KR | 10-2016-0098212 | A | 8/2016 |
| KR | 10-2017-0137066 | A | 12/2017 |
| KR | 10-2018-0121334 | A | 11/2018 |
| KR | 10-2018-0124739 | A | 11/2018 |
| KR | 10-2019-0015224 | A | 2/2019 |
| RU | 49973 | U1 | 12/2005 |
| RU | 2 647 805 | C2 | 3/2018 |
| RU | 2 665 204 | C2 | 8/2018 |
| TW | 201904454 | A | 2/2019 |
| WO | 2016/030661 | A1 | 3/2016 |
| WO | 2017/067326 | A1 | 4/2017 |
| WO | 2017/147560 | A1 | 8/2017 |
| WO | 2018/019533 | A1 | 2/2018 |
| WO | 2018/199504 | A1 | 11/2018 |
| WO | 2018/202403 | A1 | 11/2018 |
| WO | 2019/066228 | A1 | 4/2019 |

OTHER PUBLICATIONS

Communication issued Jun. 17, 2021 by the Taiwanese Patent Office in application No. 109113065.

Notice of Reasons for Refusal dated Sep. 7, 2021 from the Japanese Patent Office in JP Application No. 2020-540472.

Extended European Search Report dated Nov. 2, 2021 from the European Patent Office in EP Application No. 20751467.0.

International Search Report dated Nov. 4, 2020, in International Application No. PCT/KR2020/005019.

Communication dated Oct. 26, 2020, from the Korean Intellectual Property Office in application No. 10-2019-0045645.

Chinese Office Action dated Apr. 28, 2023 in Chinese Application No. 202080001253.4.

Office Action dated Jun. 28, 2022 issued by the Russian Patent Office in Russian Application No. 2020122899/03.

Chinese Office Action dated Oct. 8, 2023 in Chinese Application No. 202080001253.4.

* cited by examiner

[Fig. 1]
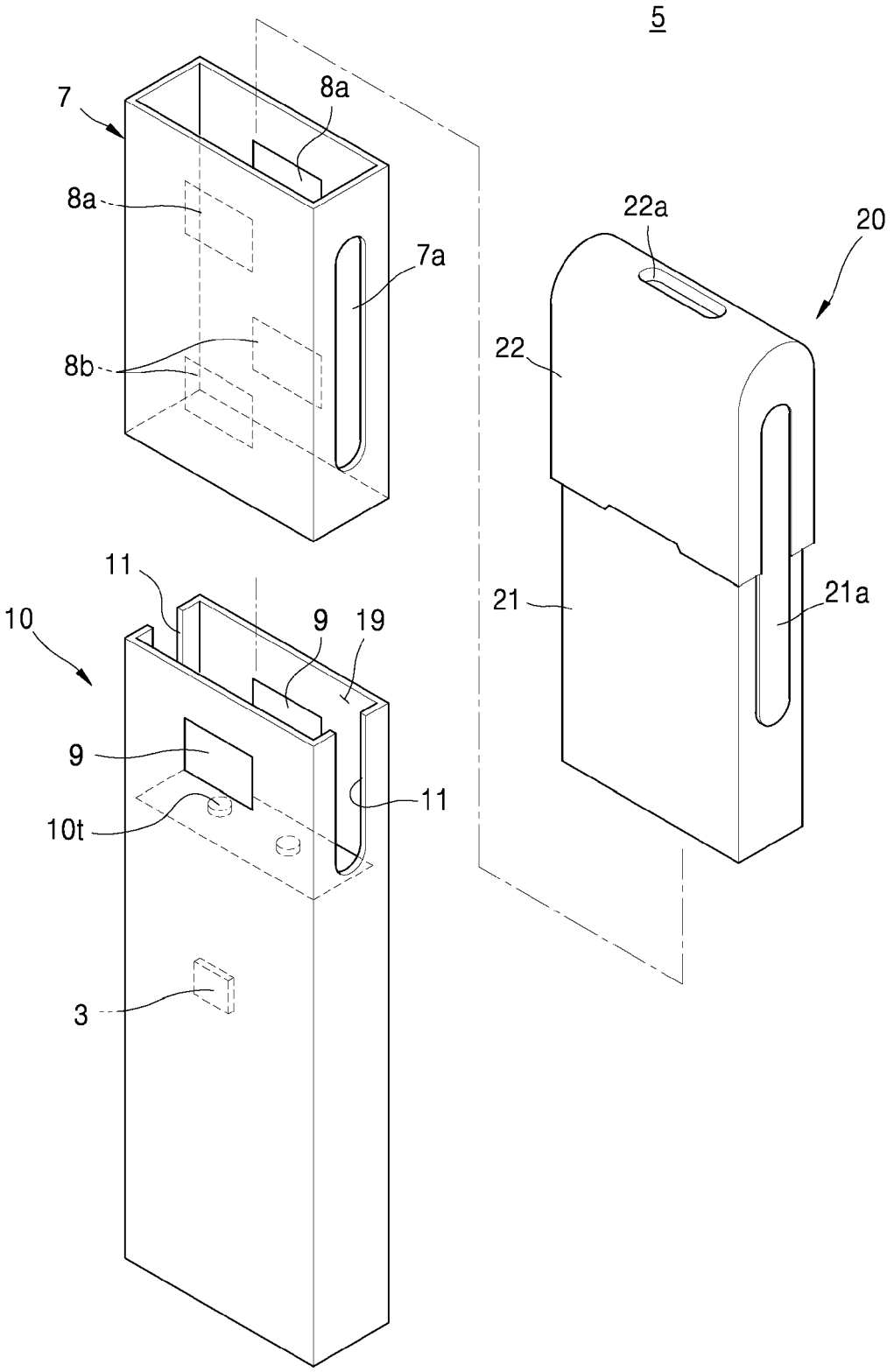

[Fig. 2]
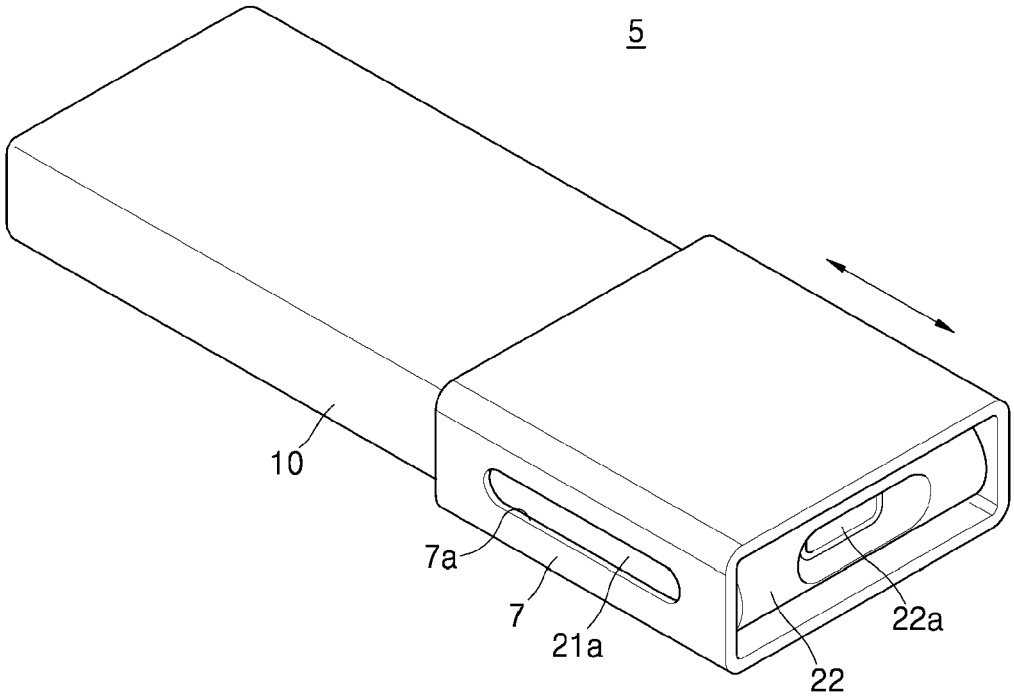
[Fig. 3]
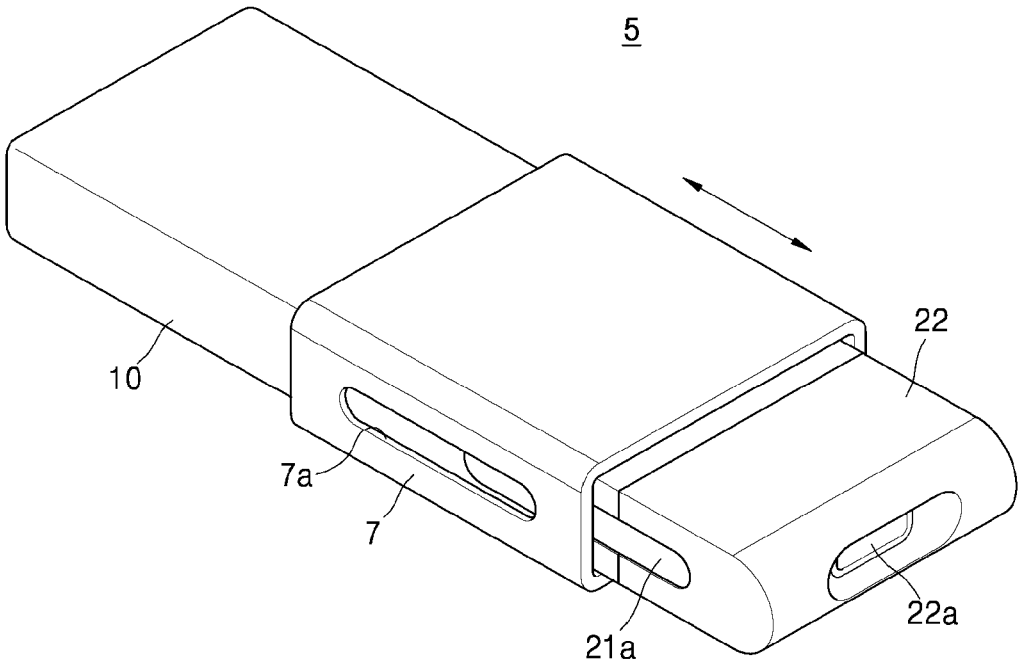

[Fig. 4]
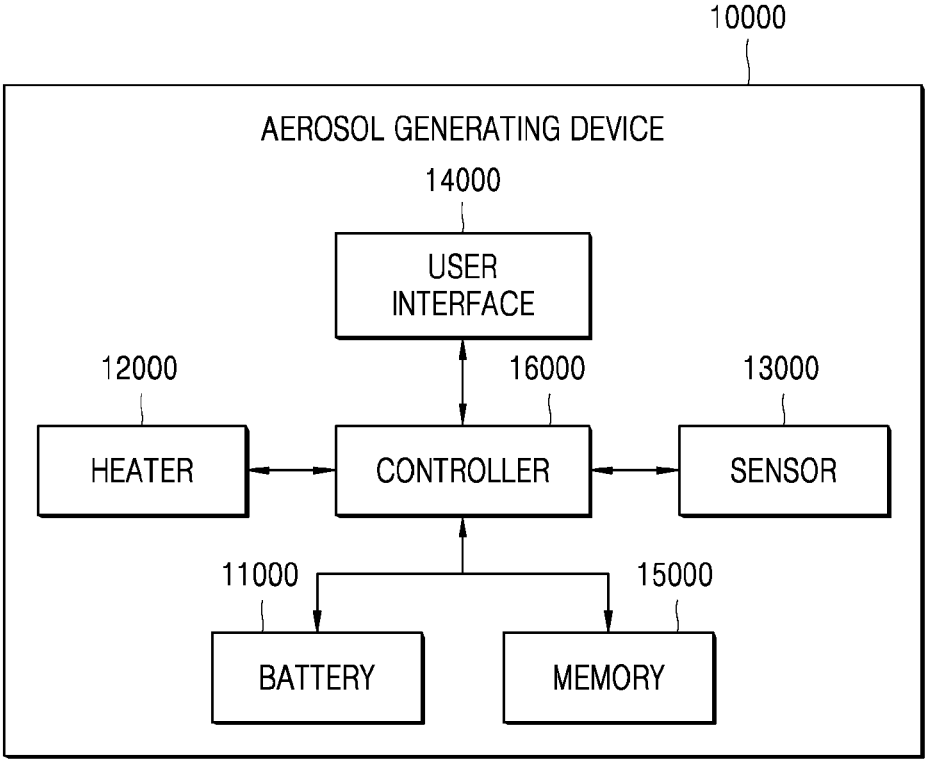
[Fig. 5]
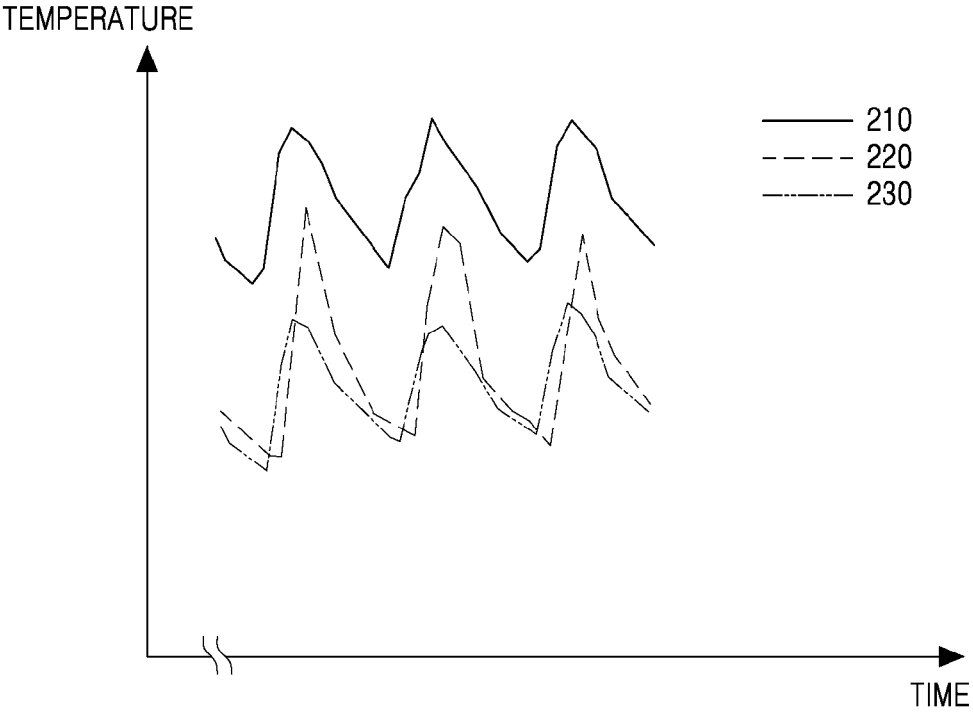

[Fig. 6]
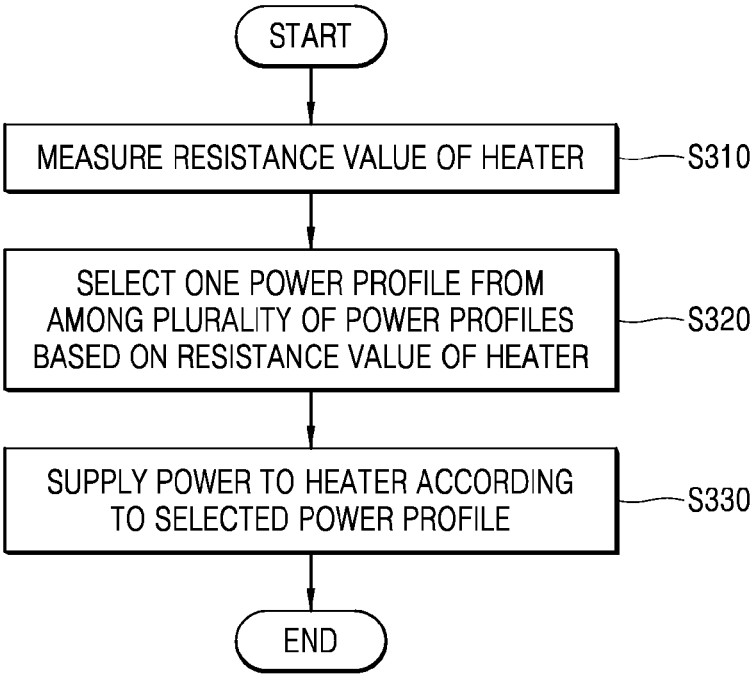

[Fig. 7]
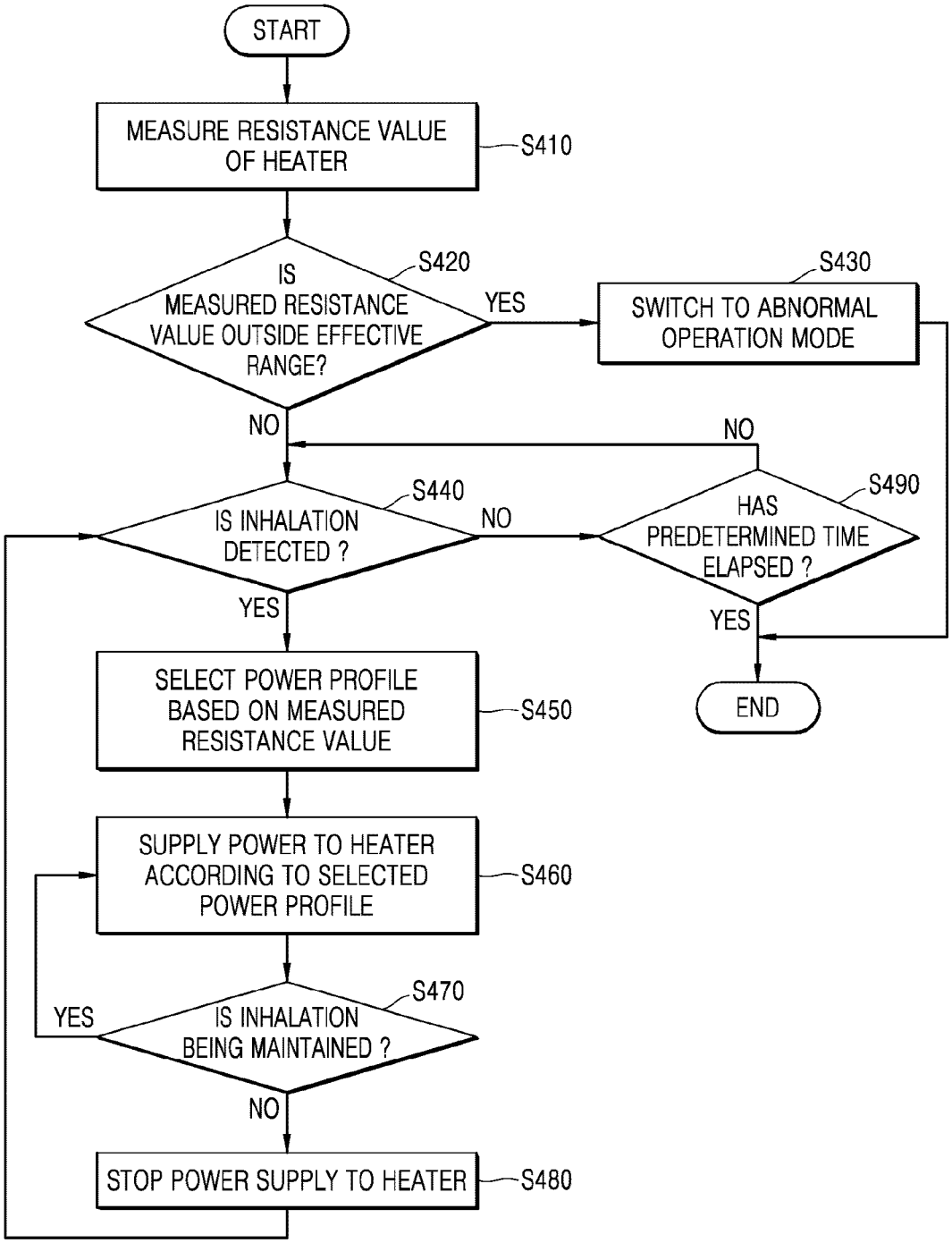

AEROSOL GENERATING DEVICE AND OPERATION METHOD THEREOF

CROSS REFERENCE TO RELATED APPLICATIONS

This application is a National Stage of International Application No. PCT/KR2020/005019, filed Apr. 14, 2020, claiming priority to Korean Patent Application No. 10-2019-0045645, filed Apr. 18, 2019.

TECHNICAL FIELD

One or more embodiments relate to an aerosol generating device and a method of operating the same.

BACKGROUND ART

Recently, there has been increasing demand for cigarette alternatives replacing normal cigarettes. For example, there is increasing demand for a method of generating aerosol by heating an aerosol generating material in cigarettes rather than by combusting cigarettes. Therefore, there has been active research into a heating-type cigarette and a heating-type aerosol generating device.

A heater included in an aerosol generating device heats an aerosol-generating material. For uniform generation of aerosol at an appropriate level, it is very important to control power supplied to the heater according to a desired temperature profile. However, even if heaters are made in the same dimensions and of the same material, resistance variations may occur between heaters due to factors including manufacturing tolerances, and thus heaters may be heated to different temperatures depending on resistances thereof even when the same power is supplied thereto. This is a problem, because a desired smoking experience may not be uniformly provided to users of aerosol generating devices.

DISCLOSURE OF INVENTION

Solution to Problem

One or more embodiments include an aerosol generating device capable of uniformly heating a heater to a desired temperature regardless of a resistance variation of the heater. Technical problems to be solved are not limited to the technical problems as described above, and other technical problems may be derived from the below embodiments.

According to one or more embodiments, an aerosol generating device includes a heater configured to heat an aerosol generating material; and a controller configured to control power supplied to the heater. The controller may measure a resistance value of the heater by using at least one electrical characteristic associated with the heater, select any one power profile from among a plurality of pre-stored power profiles including values of power to be supplied to the heater, such that a temperature of the heater reaches a target temperature within a predetermined time from a time point at which power supply to the heater is initiated regardless of variation in the resistance value of the heater, and control power supplied to the heater according to the selected power profile.

Advantageous Effects of Invention

One or more embodiments provide an aerosol generating device capable of uniformly heating a heater to a desired temperature regardless of a resistance variation of the heater.

BRIEF DESCRIPTION OF DRAWINGS

FIG. 1 is an exploded perspective view schematically illustrating a coupling relationship between a replaceable cartridge containing an aerosol generating material and an aerosol generating device including the same, according to an embodiment.

FIG. 2 is a perspective view of an example operating state of the aerosol generating device according to the embodiment illustrated in FIG. 1.

FIG. 3 is a perspective view of another example operating state of the aerosol generating device according to the embodiment illustrated in FIG. 1.

FIG. 4 is a block diagram illustrating hardware components of the aerosol generating device according to an embodiment.

FIG. 5 is a graph showing temperatures of a heater according to the lapse of time for respective resistance values of the heater of an aerosol generating device according to an embodiment.

FIG. 6 is a flowchart of a method of operating an aerosol generating device according to an embodiment.

FIG. 7 is a flowchart of a method of operating an aerosol generating device according to an embodiment.

BEST MODE FOR CARRYING OUT THE INVENTION

According to one or more embodiments, an aerosol generating device includes a heater configured to heat an aerosol generating material; and a controller configured to: measure a resistance value of the heater by using at least one electrical characteristic associated with the heater, select a power profile from among a plurality of power profiles based on the measured resistance value of the heater, and control power supplied to the heater according to the selected power profile.

According to one or more embodiments, a method of operating an aerosol generating device includes measuring a resistance value of a heater included in the aerosol generating device by using at least one electrical characteristic associated with the heater; selecting a power profile from among a plurality of power profiles based on the measured resistance value of the heater; and supplying power to the heater according to the selected power profile.

According to one or more embodiments, there is provided a computer-readable recording medium having recorded thereon a program for executing the above-stated method on a computer.

MODE FOR THE INVENTION

With respect to the terms in the various embodiments of the present disclosure, the general terms which are currently and widely used are selected in consideration of functions of structural elements in the various embodiments of the present disclosure. However, meanings of the terms may be changed according to intention, a judicial precedent, appearance of a new technology, and the like. In addition, in certain cases, there is also a term arbitrarily selected by the applicant, in which case the meaning will be described in detail in the description of one or more embodiments. Therefore, the terms used in one or more embodiments should be defined based on the meanings of the terms and the general contents of one or more embodiments, rather than simply the names of the terms.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

In addition, unless explicitly described to the contrary, the word "comprise" and variations such as "comprises" or "comprising" will be understood to imply the inclusion of stated elements but not the exclusion of any other elements. In addition, the terms "-er", "-or" and "module" described in the specification mean units for processing at least one function and operation and can be implemented by hardware components or software components and combinations thereof.

Hereinafter, example embodiments of one or more embodiments will be described in detail with reference to the accompanying drawings. One or more embodiments described below are examples. Thus, the inventive concept may be embodied in many different forms and should not be construed as being limited to the embodiments set forth herein.

Hereinafter, embodiments of one or more embodiments will be described in detail with reference to the drawings.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes the cartridge 20 containing the aerosol generating material and a main body 10 supporting the cartridge 20.

The cartridge 20 containing the aerosol generating material may be coupled to the main body 10. A portion of the cartridge 20 may be inserted into an accommodation space 19 of the main body 10 so that the cartridge 20 may be mounted on the main body 10.

The cartridge 20 may contain an aerosol generating material that is, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid, and malic acid, or may be a mixture of two or more acids selected from the above-described group, but is not limited thereto.

The cartridge 20 may be operated by an electrical signal or a wireless signal transmitted from the main body 10 to perform a function of generating aerosol by converting the phase of the aerosol generating material inside the cartridge 20 to a gaseous phase. The aerosol may refer to a gas in which vaporized particles generated from an aerosol generating material are mixed with air.

For example, in response to receiving the electrical signal from the main body 10, the cartridge 20 may convert the phase of the aerosol generating material by heating the aerosol generating material, using, for example, an ultrasonic vibration method or an induction heating method. In an embodiment, the cartridge 20 may include its own power source and generate aerosol based on an electric control signal or a wireless signal received from the main body 10.

The cartridge 20 may include a liquid storage 21 accommodating the aerosol generating material therein, and an atomizer performing a function of converting the aerosol generating material of the liquid storage 21 to aerosol.

When the liquid storage 21 "accommodates the aerosol generating material" therein, it means that the liquid storage 21 functions as a container simply holding an aerosol generating material. The liquid storage 21 may include an element impregnated with (i.e., containing) an aerosol generating material, such as a sponge, cotton, fabric, or porous ceramic structure.

The atomizer may include, for example, a liquid delivery element (e.g., a wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like. Also, the heater may be implemented by a conductive filament using a material such as a nichrome wire, and may be wound around or arranged adjacent to the liquid delivery element.

In addition, the atomizer may be implemented by a heating element in the form of a mesh or plate, which absorbs the aerosol generating material and maintains the same in an optimal state for conversion to aerosol, and generates aerosol by heating the aerosol generating material. In this case, a separate liquid delivery element may not be required.

At least a portion of the liquid storage 21 of the cartridge 20 may include a transparent portion so that the aerosol generating material accommodated in the cartridge 20 may be visually identified from the outside. The liquid storage 21 may include a protruding window 21*a* protruding from the liquid storage 21, so that the liquid storage 21 may be inserted into a groove 11 of the main body 10 when coupled to the main body 10. A mouthpiece 22 and/or the liquid storage 21 may be entirely formed of transparent plastic or glass. Alternatively, only the protruding window 21*a* may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 or supply a signal related to an operation of the cartridge 20 to the cartridge 20, through the connection terminal 10*t*.

The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

The slider 7 is coupled to the main body 10 to move with respect to the main body 10. The slider 7 covers or exposes at least a portion of the mouthpiece 22 of the cartridge 20 coupled to the main body 10 by moving with respect to the main body 10. The slider 7 includes an elongated hole 7*a* exposing at least a portion of the protruding window 21*a* of the cartridge 20 to the outside.

As shown FIG. 1, the slider 7 may have a shape of a hollow container with both ends opened, but the structure of the slider 7 is not limited thereto. For example, the slider 7 may have a bent plate structure having a clip-shaped cross-section, which is movable with respect to the main body 10 while being coupled to an edge of the main body 10. In another example, the slider 7 may have a curved semi-cylindrical shape with a curved arc-shaped cross section.

The slider 7 may include a magnetic body for maintaining the position of the slider 7 with respect to the main body 10 and the cartridge 20. The magnetic body may include a permanent magnet or a material such as iron, nickel, cobalt, or an alloy thereof.

The magnetic body may include two first magnetic bodies 8*a* facing each other, and two second magnetic bodies 8*b* facing each other. The first magnetic bodies 8*a* are arranged to be spaced apart from the second magnetic bodies 8*b* in a longitudinal direction of the main body 10 (i.e., the direction in which the main body 10 extends), which is a moving direction of the slider 7.

The main body 10 includes a fixed magnetic body 9 arranged on a path along which the first magnetic bodies 8*a* and the second magnetic bodies 8*b* of the slider 7 move as the slider 7 moves with respect to the main body 10. Two fixed magnetic bodies 9 of the main body 10 may be mounted to face each other with the accommodation space 19 therebetween.

The slider 7 may be stably maintained in positions where an end of the mouthpiece 22 is covered or exposed, by magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move as the slider 7 moves with respect to the main body 10. The position change detecting sensor 3 may include, for example, a Hall integrated circuit (IC) that uses the Hall effect to detect a change in a magnetic field, and may generate a signal based on the detected change.

In the aerosol generating device 5 according to the above-described embodiments, the main body 10, the cartridge 20, and the slider 7 have approximately rectangular cross-sectional shapes when viewed in the longitudinal direction, but in the embodiments, the shape of the aerosol generating device 5 is not limited. The aerosol generating device 5 may have, for example, a cross-sectional shape of a circle, an ellipse, a square, or various polygonal shapes. In addition, the aerosol generating device 5 is not necessarily limited to a structure that extends linearly, and may be curved in a streamlined shape or bent at a preset angle to be easily held by the user.

FIG. 2 is a perspective view of an example operating state of the aerosol generating device according to the embodiment illustrated in FIG. 1.

In FIG. 2, the slider 7 is moved to a position where the end of the mouthpiece 22 of the cartridge coupled to the main body 10 is covered. In this state, the mouthpiece 22 may be safely protected from external impurities and kept clean.

The user may check the remaining amount of aerosol generating material contained in the cartridge by visually checking the protruding window 21*a* of the cartridge through the elongated hole 7*a* of the slider 7. The user may move the slider 7 in the longitudinal direction of the main body 10 to use the aerosol generating device 5.

FIG. 3 is a perspective view of another example operating state of the aerosol generating device according to the embodiment illustrated in FIG. 1.

In FIG. 3, the operating state is shown in which the slider 7 is moved to a position where the end of the mouthpiece 22 of the cartridge coupled to the main body 10 is exposed to the outside. In this state, the user may insert the mouthpiece 22 into his or her mouth and inhale aerosol discharged through the discharge hole 22*a* of the mouthpiece 22.

As shown in FIG. 3, the protruding window 21*a* of the cartridge is still exposed to the outside through the elongated hole 7*a* of the slider 7 when the slider 7 is moved to the position where the end of the mouthpiece 22 is exposed to the outside. Thus, the user may be able to visually check the remaining amount of aerosol generating material contained in the cartridge, regardless of the position of the slider 7.

FIG. 4 is a block diagram illustrating components of the aerosol generating device according to an embodiment.

Referring to FIG. 4, the aerosol generating device 10000 may include a battery 11000, a heater 12000, a sensor 13000, a user interface 14000, a memory 15000, and a controller 16000. However, the internal structure of the aerosol generating device 10000 is not limited to the structures illustrated in FIG. 4. Also, it will be understood by one of ordinary skill in the art that some of the hardware components shown in FIG. 4 may be omitted or new components may be added according to the design of the aerosol generating device 400.

In an embodiment where the aerosol generating device 10000 includes a main body without a cartridge, the components shown in FIG. 4 may be located in the main body. In another embodiment where the aerosol generating device 10000 includes a main body and a cartridge, the components shown in FIG. 4 may be located in the main body and/or the cartridge.

The battery 11000 supplies electric power to be used for the aerosol generating device 10000 to operate. For example, the battery 11000 may supply power such that the heater 12000 may be heated. In addition, the battery 11000 may supply power required for operation of other components of the aerosol generating device 10000, such as the sensor 13000, the user interface 14000, the memory 15000, and the controller 16000. The battery 11000 may be a rechargeable battery or a disposable battery. For example, the battery 11000 may be a lithium polymer (LiPoly) battery, but is not limited thereto.

The heater 12000 receives power from the battery 11000 under the control of the controller 16000. The heater 12000 may receive power from the battery 11000 and heat a cigarette inserted into the aerosol generating device 10000, or heat the cartridge mounted on the aerosol generating device 10000.

The heater 12000 may be located in the main body of the aerosol generating device 10000. Alternatively, the heater 12000 may be located in the cartridge. When the heater 12000 is located in the cartridge, the heater 12000 may receive power from the battery 11000 located in the main body and/or the cartridge.

The heater 12000 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 12000 may be implemented by a metal wire, a metal plate on which an electrically conductive track is arranged, or a ceramic heating element, but is not limited thereto.

In an embodiment, the heater 12000 may be included in the cartridge. The cartridge may include the heater 12000, the liquid delivery element, and the liquid storage. The aerosol generating material accommodated in the liquid storage may be absorbed by the liquid delivery element, and the heater 12000 may heat the aerosol generating material absorbed by the liquid delivery element, thereby generating aerosol. For example, the heater 12000 may include a material such as nickel or chromium, and may be wound around or arranged adjacent to the liquid delivery element.

In another embodiment, the heater 12000 may heat the cigarette inserted into the accommodation space of the aerosol generating device 10000. When the cigarette is accommodated in the accommodation space of the aerosol generating device 10000, the heater 12000 may be located inside and/or outside the cigarette and may generate aerosol by heating the aerosol generating material in the cigarette.

Meanwhile, the heater 12000 may include an induction heater. The heater 12000 may include an electrically conductive coil for heating a cigarette or the cartridge by an induction heating method, and the cigarette or the cartridge may include a susceptor which may be heated by the induction heater.

The aerosol generating device 10000 may include at least one sensor 13000. A result sensed by the at least one sensor 13000 is transmitted to the controller 16000, and the controller 16000 may control the aerosol generating device 10000 by controlling the operation of the heater, restricting smoking, determining whether a cigarette (or a cartridge) is inserted, displaying a notification, etc.

For example, the sensor 13000 may include a puff detecting sensor. The puff detecting sensor may detect a user's puff based on a temperature change, a flow change, a voltage change, and/or a pressure change. The term "puff" may be used interchangeably with the term "inhale" throughout the specification.

The sensor 13000 may include a temperature sensor. The temperature sensor may detect a temperature of the heater 12000 (or an aerosol generating material). The aerosol generating device 10000 may include a separate temperature sensor for sensing a temperature of the heater 12000, or the heater 12000 itself may serve as a temperature sensor without a separate temperature sensor. Alternatively, an additional temperature sensor may be further included in the aerosol generating device 10000 even when the heater 12000 serves as a temperature sensor.

The sensor 13000 may include a position change detecting sensor. The position change detecting sensor may detect a change in a position of the slider which is coupled to the main body and slides along the main body.

Also, the sensor 13000 may further include a resistance sensor that identifies a resistance value. For example, the resistance sensor may determine the resistance value of the heater 12000 by measuring electrical characteristics (for example, voltage, current, power, conductance, etc.) associated with the heater 12000.

The user interface 14000 may provide the user with information about the state of the aerosol generating device 10000. For example, the user interface 14000 may include various interfacing devices, such as a display or a light emitter for outputting visual information, a motor for outputting haptic information, a speaker for outputting sound information, input/output (I/O) interfacing devices (for example, a button or a touch screen) for receiving information input from the user or outputting information to the user, terminals for performing data communication or receiving charging power, and/or communication interfacing modules for performing wireless communication (for example, Wi-Fi, Wi-Fi direct, Bluetooth, near-field communication (NFC), etc.) with external devices.

The memory 15000 may store various data processed or to be processed by the controller 16000. The memory 15000 may include various types of memories, such as dynamic random access memory (DRAM), static random access memory (SRAM), read-only memory (ROM), electrically erasable programmable read-only memory (EEPROM), etc.

For example, the memory 15000 may store an operation time of the aerosol generating device 10000, the maximum number of puffs, the current number of puffs, at least one temperature profile, data on a user's smoking pattern, etc.

The controller 16000 may control overall operations of the aerosol generating device 10000. The controller 16000 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor may be implemented as another type of hardware.

The controller 16000 analyzes a result of the sensing by at least one sensor 13000, and controls processes that are to be performed subsequently.

The controller 16000 may control power supplied to the heater 12000 so that the operation of the heater 12000 is started or terminated, based on the result of the sensing by the sensor 13000. In addition, based on the result of the sensing by the sensor 13000, the controller 16000 may control the amount of power supplied to the heater 12000 and the time at which the power is supplied, so that the heater 12000 is heated to a predetermined temperature and/or maintained at an appropriate temperature.

In an embodiment, the controller 16000 may set a mode of the heater 12000 to a preheating mode to start the operation of the heater 12000 after receiving a user input to the aerosol generating device 10000. In addition, the controller 16000 may switch the mode of the heater 12000 from the pre-heating mode to an operation mode after detecting a user's puff by using the puff detecting sensor. In addition, the controller 16000 may stop supplying power to the heater 12000 when the number of puffs reaches a preset number after counting the number of puffs by using the puff detecting sensor.

The controller 16000 may control the user interface 14000 based on the result of the sensing by the at least one sensor 13000. For example, when the number of puffs counted by the puff detecting sensor reaches a preset number, the controller 16000 may notify the user by using the user interface 14000 (e.g., a light emitter, a motor, a speaker, etc.) that the aerosol generating device 10000 will soon be terminated.

Although not illustrated in FIG. 4, the aerosol generating device 10000 may be combined with a separate cradle to form an aerosol generating system. For example, the cradle may be used to charge the battery 11000 of the aerosol generating device 10000. For example, the aerosol generating device 10000 may be supplied with power from a battery of the cradle to charge the battery 11000 of the aerosol generating device 10000 while being accommodated in an accommodation space of the cradle.

Hereinafter, an operation of the aerosol generating device 10000 capable of uniformly heating a heater to a desired temperature regardless of the resistance variation of the heater according to one or more embodiments will be described with reference to FIGS. 5 to 7.

The controller 16000 may count the number of puffs (i.e., smoking or inhalation) of a user through the aerosol generating device 10000. The controller 16000 may control power supply to the heater 12000 according to a result of the counting.

According to an embodiment, the controller 16000 may supply power of a pre-set amount for each of detected inhalations. For example, during a heating operation period of one cycle in which a predetermined number of inhalations are repeated, the controller 16000 may supply power P1 to the heater 12000 in response to a first inhalation and supply power P2 to the heater 12000 in response to a second inhalation. According to embodiments, the power P1 and the power P2 may be different from or identical to each other.

According to an embodiment, the controller 16000 may control the aerosol generating device 10000 to restrict smoking of a user according to a result of the counting.

According to an embodiment, a memory stores a plurality of power profiles for regulating power supplied to the heater 12000. The power profile may be used to determine power supplied to the heater 12000 according to the lapse of time or the counted number of inhalations. Each power profile may correspond to each resistance value that the heater 12000 may have. In other words, power profiles may include power values and their corresponding resistance values of the heater 12000, which are determined in advance. For example, the power profiles may include individual power values determined for respective counted number of detected inhalations. Also, the power profiles may include individual power values according to the lapse of time.

FIG. 5 is a graph showing temperatures of the heater 12000 according to the lapse of time for respective resistance values of the heater 12000 of the aerosol generating device 10000 according to an embodiment.

Peaks shown in FIG. 5 indicate an elevated temperature corresponding to power applied to the heater 12000 as a user's inhalation is detected. As can be seen in FIG. 5, three inhalations are detected in this case.

Even if the heaters 12000 are manufactured with the same material and in the same dimensions (e.g., a length and a cross-sectional area), they may have different resistance values due to influences of various factors in a manufacturing process. For example, when the heaters 12000 have resistance values R1, R2, and R3 (R1, R2, and R3 are different from one another), different currents flow in the respective heaters 12000 even when power of the same value is supplied, and thus the temperatures become also different for the respective heaters 12000. When the preferred resistance value of the heater 12000 is R3 and a target temperature profile corresponding to R3 may be a temperature profile 230 in FIG. 5. In this case, the temperature profiles 210 and 220 may correspond to the resistance values of R1 and R2 of the heater 12000, respectively.

In a case where power P3 is determined in advance as corresponding to a target temperature of the heater having the resistance value R3, a heater having resistance value R1 or R2 may be heated to a temperature different from the target temperature. As such, pre-designed atomization and smoking sensation that are designed in advance for proper smoking experience of a user may not be realized. This problem becomes more serious when a temperature sensing sensor for sensing the temperature of the heater 12000 is not separately provided in the aerosol generating device 10000.

The aerosol generating device 10000 according to one or more embodiments may select different power profiles according to resistance values of the heater 12000, thereby heating the heater 12000 to the same target temperature despite the variation in the resistance value of the heater 12000. Hereinafter, one or more embodiments will be described in detail.

According to an embodiment, the controller 16000 measures the resistance value of the heater 12000 through the sensor 13000. For example, the controller 16000 may receive a result of measuring electrical characteristics (e.g., a voltage, a current, power, conductance, etc.) associated with the heater 12000 from a resistance sensor included in the sensor 13000 and determine the resistance value of the heater 12000 based on the result. In some embodiments, the resistance sensor may be included in the cartridge 20. In this case, the cartridge 20 may transmit a resistance value measured by the resistance sensor to the controller 16000 through a communication interface (not shown), and the controller 16000 may control power supply to the heater 12000 by using the resistance value received from the cartridge 20.

According to an embodiment, the resistance value of heater 12000 may be measured prior to initiating power supply to the heater 12000. Since the resistance value of the heater 12000 is correlated with its temperature, the resistance variation inherent in the heater 12000 needs to be accurately reflected in controlling power supplied to the heater 12000. By measuring the resistance value of the heater 12000 before power is supplied to the heater 12000 (that is, before the heater 12000 is heated), the temperature of the heater 12000 may be precisely controlled.

The controller 16000 may select one of a plurality of pre-stored power profiles indicating power to be supplied to the heater 12000 according to the measured resistance value of the heater 12000. According to an embodiment, the plurality of pre-stored power profiles include values of power to be supplied to the heater 12000, which causes the temperature of the heater 12000 to reach a target temperature within a predetermined period of time from a time point at which power supply to the heater 12000 is initiated, regardless of variation of the resistance value of the heater 12000.

According to an embodiment, the plurality of pre-stored power profiles may include values of power respectively determined in advance, which correspond to resistance values of the heater 12000.

For example, when the resistance value of the heater 12000 is measured as R1, a power profile for supplying power P1 to the heater 12000 may be selected. When the resistance value of the heater 12000 is measured as R2, a power profile for supplying power P2 to the heater 12000 may be selected. When the resistance value of the heater 12000 is measured as R3, a power profile for supplying power P3 to the heater 12000 may be selected. Here, each power profile may be set in advance, such that the heater 12000 may be heated to the same target temperature (or temperature range) within a predetermined time. By power supply according to power profiles corresponding to the respective resistance values, the heater 12000 having the resistance value R1, the heater 12000 having the resistance value R2, and the heater 12000 having the resistance value R3 may all be heated to the same target temperature.

The relationship between a measured resistance value of the heater 12000 and an amount of power supplied to the heater 12000 may be stored in the memory 15000 in advance in the form of a look-up table (LUT). When the resistance value of the heater 12000 is measured, the controller 16000 may access a look-up table, identify a power value associated with the measured resistance value, and control power supplied to the heater 12000 such that power corresponding to the identified power value is supplied to the heater 12000.

According to an embodiment, predetermined power values included in the each power profile may include individual power values determined for respective counts of detected inhalation. The inhalations may be counted within a heating operation period of one cycle in which a predetermined number of inhalations are repeated or may be counted throughout the lifespan of the cartridge 20.

For example, when the resistance value of the heater 12000 is measured as R1, a power profile for supplying power P11 for a first detected inhalation, supplying power P12 for a second detected inhalation, and supplying power P13 for a third detected inhalation may be selected. When the resistance value of the heater 12000 is measured as R2, a power profile for supplying power P21 for a first detected inhalation, supplying power P22 for a second detected inhalation, and supplying power P23 for a third detected inhalation may be selected. When the resistance value of the heater 12000 is measured as R3, a power profile for supplying power P31 for a first detected inhalation, supplying power P32 for a second detected inhalation, and supplying power P33 for a third detected inhalation may be selected.

The controller 16000 controls power supplied to the heater 12000 according to a selected power profile.

According to an embodiment, the controller 16000 may determine whether a measured resistance value of the heater 12000 is within a preset effective range and control power supplied to the heater 12000 according to a result of the determination.

For example, when the resistance value of the heater 12000 is outside the preset effective range, even when an inhalation is detected, the controller 16000 may not supply power to the heater 12000 or may supply power to the heater 12000 outside a range for generating aerosol. In this case, a user may be notified that aerosol is not generated despite inhalation because the heater 12000 is not effective. For example, a notification that replacement of the cartridge 20 is required may be output. However, the operation of the controller 16000 is not limited to the above-described example and may notify a user that the heater 12000 is not effective in a different way. In an embodiment, the controller 16000 may not perform operations that are supposed to be performed in response to a predetermined operation of the user.

For example, when the resistance value of the heater 12000 is outside the preset effective range, the controller 16000 may output a notification that the aerosol generating device 10000 is unable to operate through the user interface 14000. The controller 16000 may output information indicating that the aerosol generating device 10000 is unable to operate in various types of information, such as visual information, auditory information, and tactile information.

FIG. 6 is a flowchart of a method of operating the aerosol generating device 10000 according to an embodiment.

In operation S310, the aerosol generating device 10000 may measure the resistance value of the heater 12000. For example, the aerosol generating device 10000 may receive a result of measuring electrical characteristics (e.g., a voltage, a current, power, conductance, etc.) associated with the heater 12000 from a resistance sensor and determine the resistance value of the heater 12000 based on the result.

For example, operation S310 may be performed before initiation of power supply to the heater 12000. Since the resistance value of the heater 12000 is correlated with temperature, the resistance variation inherent in the heater 12000 may be more accurately reflected by measuring the resistance value of the heater 12000 before power is supplied to the heater 12000 (that is, before the heater 12000 is heated). As such, the precision of controlling the heater 12000 may be improved.

In operation S320, the aerosol generating device 10000 may select one of a plurality of pre-stored power profiles indicating different values of power to be supplied to the heater 12000 according to the measured resistance value of the heater 12000. According to an embodiment, the plurality of pre-stored power profiles include values of power to be supplied to the heater 12000 which cause the temperature of the heater 12000 to reach a target temperature within a predetermined period of time from a time point at which power supply to the heater 12000 is initiated, regardless of variation of the resistance value of the heater 12000.

In operation S330, the aerosol generating device 10000 may supply power to the heater 12000 according to the power profile selected in operation S320.

FIG. 7 is a flowchart of a method of operating the aerosol generating device 10000 according to an embodiment.

In operation S410, the aerosol generating device 10000 may measure the resistance value of the heater 12000. Operation S410 may be performed in the same or similar manner as operation S310 of FIG. 6 described above.

In operation S420, the aerosol generating device 10000 may determine whether the measured resistance value of the heater 12000 is within a preset effective range. The aerosol generating device 10000 may control power supplied to the heater 12000 according to a result of the determination in operation S420.

When it is determined that the resistance value of the heater 12000 is outside the preset effective range, the aerosol generating device 10000 may switch to an abnormal operation mode (operation S430). In the abnormal operation mode, even when an inhalation of a user is detected, the aerosol generating device 10000 may not supply power to the heater 12000 or supply power to the heater 12000 outside a range for generating aerosol. Also, in the abnormal operation mode, the aerosol generating device 10000 may output a notification that the aerosol generating device 10000 is unable to operate. The aerosol generating device 10000 may output a notification that replacement of the cartridge 20 is required.

When it is determined that the resistance value of the heater 12000 is within the preset effective range, the aerosol generating device 10000 may further determine whether an inhalation of the user is detected (operation S440).

When an inhalation is detected, in operation S450, the aerosol generating device 10000 may select a power profile based on the measured resistance value of the heater 12000. Operation S450 may be performed in the same or similar manner as operation S320 of FIG. 6 described above. Although FIG. 7 shows that the power profile is selected in operation S450 after an inhalation is detected in operation S440, one or more embodiments are not limited thereto. In some embodiments, a power profile may be selected in advance based on a measured resistance value before an inhalation is detected.

In operation S460, the aerosol generating device 10000 may supply power to the heater 12000 according to the power profile selected in operation S450.

In operation S470, the aerosol generating device 10000 determines whether the inhalation is being maintained. When the inhalation is being maintained, the aerosol generating device 10000 may continue power supply to the heater 12000.

When it is determined that the inhalation is not being maintained, in operation S480, the aerosol generating device 10000 may stop power supply to the heater 12000.

When no inhalation is detected in operation S440, the aerosol generating device 10000 may determine in operation S490 whether a predetermined time has elapsed without detecting an inhalation of the user. As a result of the determination, when the predetermined time has elapsed, the aerosol generating device 10000 may be deactivated and turned off.

In FIG. 7, operation S450 for selecting a power profile based on a measured resistance value may be performed only for an inhalation of a particular counted number (e.g., only when the first inhalation is detected) and may be omitted when subsequent inhalations are detected. In other words, when subsequent inhalations are detected, a power profile may not be selected again, and power may be supplied to the heater 12000 according to a previously selected power profile.

FIGS. 6 and 7 show that operations S310 to S330 and operations S410 to S490 are performed sequentially, but the illustrations are merely examples and such operations are not limited to chronological order. One of ordinary skill in the art to which one or more embodiments pertain may modify the sequences disclosed herein or make various modifications by executing one or more operations in parallel without departing from the technical spirit of one or more embodiments.

The method of operating an aerosol generating device according to an embodiment may also be implemented in the form of a recording medium including instructions executable by a computer, such as program modules to be executed by a computer. The computer-readable recording medium may be any available medium that can be accessed by a computer and includes both volatile and nonvolatile media, and removable and non-removable media. In addition, the computer-readable medium may include both a computer storage medium and a communication medium. The computer storage medium includes all of volatile and nonvolatile, and removable and nonremovable media implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer media.

At least one of the components, elements, modules or units (collectively "components" in this paragraph) represented by a block in the drawings such as the user interface 14000 and the controller 16000 in FIG. 3, may be embodied as various numbers of hardware, software and/or firmware structures that execute respective functions described above, according to an example embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above example embodiments may be implemented in algorithms that execute on one or more processors. Furthermore, the components represented by a block or processing steps may employ any number of related art techniques for electronics configuration, signal processing and/or control, data processing and the like.

Those of ordinary skill in the art pertaining to the present embodiments can understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating device comprising:

a heater configured to heat an aerosol generating material; and a controller configured to:

measure a resistance value of the heater by using at least one electrical characteristic associated with the heater, select a power profile from among a plurality of power profiles based on the measured resistance value of the heater, and control power supplied to the heater according to the selected power profile, wherein the controller is further configured to control power supplied to the heater based on whether the measured resistance value of the heater is within a predetermined effective range, wherein, based on the measured resistance value of the heater being out of the predetermined effective range, when an inhalation is detected, the controller is further configured to supply power to the heater outside a range for generating aerosol.

2. The aerosol generating device of claim 1, wherein the plurality of power profiles comprise a plurality of power values respectively associated with a plurality of resistance values of the heater, the plurality of power values causing the heater to reach a target temperature within a predetermined time from a time point at which power supply to the heater is initiated, regardless of the measured resistance value of the heater.

3. The aerosol generating device of claim 1, wherein the resistance value of the heater is measured before initiation of power supply to the heater.

4. The aerosol generating device of claim 1, wherein each of the plurality of power profiles comprises predetermined power values.

5. The aerosol generating device of claim 4, wherein the predetermined power values are respectively associated with counted numbers of inhalation detected during a heating operation period.

6. The aerosol generating device of claim 1, wherein, based on the measured resistance value of the heater being outside the predetermined effective range, the controller is further configured to output a notification that the aerosol generating device is unable to operate.

7. A method of operating an aerosol generating device, the method comprising:

measuring a resistance value of a heater included in the aerosol generating device by using at least one electrical characteristic associated with the heater;

selecting a power profile from among a plurality of power profiles based on the measured resistance value of the heater;

supplying power to the heater according to the selected power profile, determining whether the measured resistance value of the heater is within a predetermined effective range; and based on the measured resistance value of the heater being out of the predetermined effective range, when an inhalation is detected, supplying power to the heater outside a range for generating aerosol.

8. The method of claim 7, wherein the plurality of power profiles comprise a plurality of power values respectively associated with a plurality of resistance values of the heater, the plurality of power values causing the heater to reach a target temperature within a predetermined time from a time point at which power supply to the heater is initiated, regardless of the measured resistance value of the heater.

9. The method of claim 7, wherein each of the plurality of power profiles comprises predetermined power values.

10. The method of claim 9, wherein the predetermined power values are respectively associated with counted numbers of inhalation detected during a heating operation period.

11. A non-transitory computer-readable recording medium storing instructions that, when executed by a controller, cause the controller to perform the method of claim 7.

* * * * *